US006600258B2

(12) United States Patent
Gorog et al.

(10) Patent No.: US 6,600,258 B2
(45) Date of Patent: Jul. 29, 2003

(54) TENSION MASK FOR A CATHODE-RAY-TUBE

(75) Inventors: Istvan Gorog, Lancaster, PA (US); Leonard Pratt Wilbur, Jr., Lancaster, PA (US)

(73) Assignee: Thomson Licensing S.A., Boulogne Cedex (FR)

( * ) Notice: Subject to any disclaimer, the term of this patent is extended or adjusted under 35 U.S.C. 154(b) by 45 days.

(21) Appl. No.: 10/053,153

(22) Filed: Oct. 29, 2001

(65) Prior Publication Data

US 2003/0080666 A1 May 1, 2003

(51) Int. Cl.[7] ..... H01J 29/80
(52) U.S. Cl. ..... 313/402; 313/407
(58) Field of Search ..... 313/402, 407, 313/403, 408

(56) References Cited

U.S. PATENT DOCUMENTS

| | | | | | |
|---|---|---|---|---|---|
| 4,942,333 | A | | 7/1990 | Knox | 313/402 |
| 5,647,653 | A | | 7/1997 | Cherukuri | 313/402 |
| 6,100,629 | A | * | 8/2000 | Han et al. | 313/402 |
| 6,111,346 | A | * | 8/2000 | Ito et al. | 313/402 |
| 6,225,736 | B1 | | 5/2001 | Gorog | 313/407 |
| 6,274,975 | B1 | | 8/2001 | Reed et al. | 313/407 |
| 6,407,488 | B1 | * | 6/2002 | Ragland | 313/407 |
| 6,441,546 | B1 | * | 8/2002 | Arai | 313/402 |
| 6,455,992 | B1 | * | 9/2002 | Thomson et al. | 313/402 |

* cited by examiner

*Primary Examiner*—Gary Paumen
(74) *Attorney, Agent, or Firm*—Joseph S. Tripoli; Joseph J. Laks; Carlos M. Herrera

(57) ABSTRACT

The present invention provides a tension mask for a cathode-ray tube. The tension mask has an active aperture portion formed by a plurality of parallel strands extending between cantilevers on opposed sides of a mask support frame. The tension mask further comprises border shields mounted over each end of the frame cantilevers, whereby the strand ends are held to the cantilevers in a predetermined spaced-apart relationship. The border shields on opposing sides of the frame extend toward the active aperture portion of the tension mask and is substantially aligned with the screen matrix of the CRT. The tension mask has a lower coefficient of thermal expansion than that of the mask frame, cantilevers, and border shield.

10 Claims, 2 Drawing Sheets

TENSION MASK FOR A CATHODE-RAY-TUBE

The present invention relates to a tension mask for a color cathode-ray-tube and, more particularly, a tension mask having a border shield.

BACKGROUND OF THE INVENTION

A conventional shadow mask type color cathode-ray-tube generally comprises an electron gun for forming and directing three electron beams to a screen of the tube. The screen is located on the inner surface of the faceplate of the tube and is made up of an array of elements of three different color-emitting phosphors. In manufacturing the tube, a shadow mask, which is positioned with respect to the faceplate, is used in printing the screen array and, as such, defining the array borders. During tube operation, the shadow mask is precisely interposed between the gun and the screen to replicate the source positions during the screening process. The shadow mask effectively acts as a parallax barrier that shadows the screen and permits the transmitted portions of the electron beams to excite phosphor elements of the respective emissive color on the cathode-ray-tube screen.

In conventional tubes, the shadow mask is a domed thin sheet of metal capable of self-maintaining its configuration with the inner surface of the tube faceplate and is supported by a mask frame. Another group of masks commonly used in tubes are tension masks. Examples of tension type masks are tie bar and strand tension masks. Strand tension masks comprise a plurality of thin parallel strands that are stretched and welded to a rigid mask frame. The stretching of the strands provides the predetermined tension in the vertical dimension which is required to ensure that the apertures formed between the strands remain in alignment with the phosphor elements on the screen. In order to maintain the tension on the mask, the mask must be attached to a relatively massive frame.

Two different forms of attaching the strands to a frame can be found in conventional tubes. One form includes a border surrounding the central apertures of the mask which is welded to the frame. The solid border of the mask serves as an optical edge for forming the black surround of the matrix which in turn defines the borders of the screen array of the tube screen. A secondary purpose of the solid mask border is to provide an electron shield at the edge of the active scan region so as to reduce undesirable electron scattering during vertical overscan. The second form for attaching the strands includes attaching the ends of each individual mask strand to the frame. Both forms of tension masks have been found desirable for a number of reasons including aesthetic appearance of tubes with a face having limited or no curvature at all.

It has also been found desirable to make the mask and the mask frame from different materials to reduce the required mask tension and weight of the mask-frame assembly. In commercial tension mask tubes, solid borders of the mask are welded to the mask frame. The consequence of having a solid border of the mask welded to a frame when the mask and the frame have different thermal expansion coefficients is that deformation of the solid borders will occur along the mask-to-frame weld points during thermal processing of the tube, thereby permanently deforming the active portion of the mask. Such deformation has led the way to efforts to individually attach mask strands (or other etch mask portions) to the mask frame, wherein no solid mask border is attached to the frame. Unfortunately, individual attachment of mask strands has as also been problematic because the strands tend to displace from the pushing action of weld devices during welding. In addition to the process problems of attaching individual strands to the frame, the absence of solid mask borders is also not desirable because the borders serve as optical edges for forming and defining the black matrix surround and screen array and they also block stray electrons caused by the collision of the electron beam against the sides of the mask frame. Therefore, an invention is required that allows for individual attachment of mask strands to a mask frame without deformation, while also providing some terminating shielding which will serve as an optical edge for matrix and screening and a shield for stray electrons.

SUMMARY OF THE INVENTION

The present invention provides a tension mask for a cathode-ray-tube. The tension mask includes a frame with cantilevers attached to opposing sides of the frame and a plurality of spaced apart parallel strands extending between the cantilevers of the frame. A border shield is mounted over the strands along each edge of the frame cantilevers for subsequent welding technique. The border shield is incorporated to move into gripping relation with the respective strand ends, whereby the strands are held to the cantilevers in a predetermined space-apart relation.

BRIEF DESCRIPTION OF THE DRAWINGS

The teachings of the present invention can be readily understood by considering the following detailed description in conjunction with the accompanying drawings, in which.

DETAILED DESCRIPTION

Figure 1:
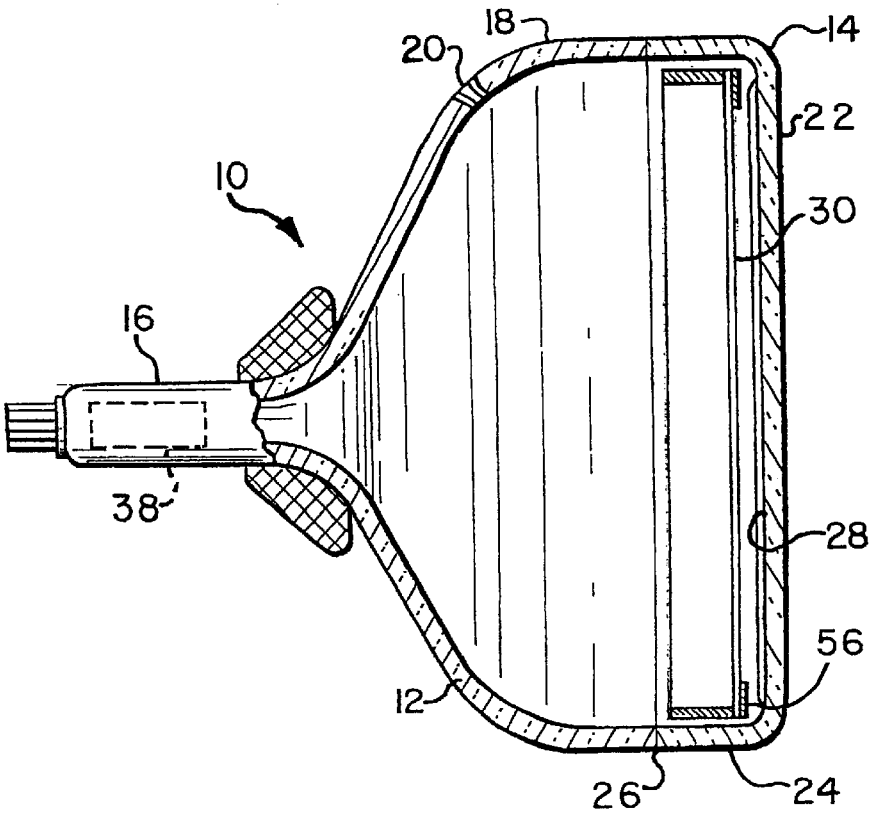
FIG. 1 is a cross-sectional side view of a color cathode-ray-tube, including a tension mask assembly according to the present invention.

FIG. 1 shows a conventional cathode-ray-tube 10 having a glass envelope 12 comprises a rectangular faceplate panel 14 and a tubular neck 16 connected by a rectangular funnel 18. An internal conductive coating (not shown) on the funnel 18 extends from an anode button 20 back to a neck 16 and also extends toward the faceplate panel 14. The panel 14 comprises a viewing faceplate 22 and a peripheral flange or sidewall 24 that is sealed to the funnel 18 by a glass frit 26. A three-color phosphor luminescent screen 28 (microstructure not shown) is carried by the inner surface of the faceplate 22. The screen 28 is a line screen which includes a multiplicity of screen elements comprised of red-emitting, green-emitting and blue-emitting phosphor stripes R, G, and B, respectively, arranged in color groups or picture elements of three stripes or triads, each triad including a phosphor line pattern of each of the three colors. The phosphor lines approximately parallel a minor axis, Y, of the tube. Preferably, at least a portion of the phosphor stripes overlap a relatively thin, light absorbing matrix (not shown), as is known in the art.

Figure 2:
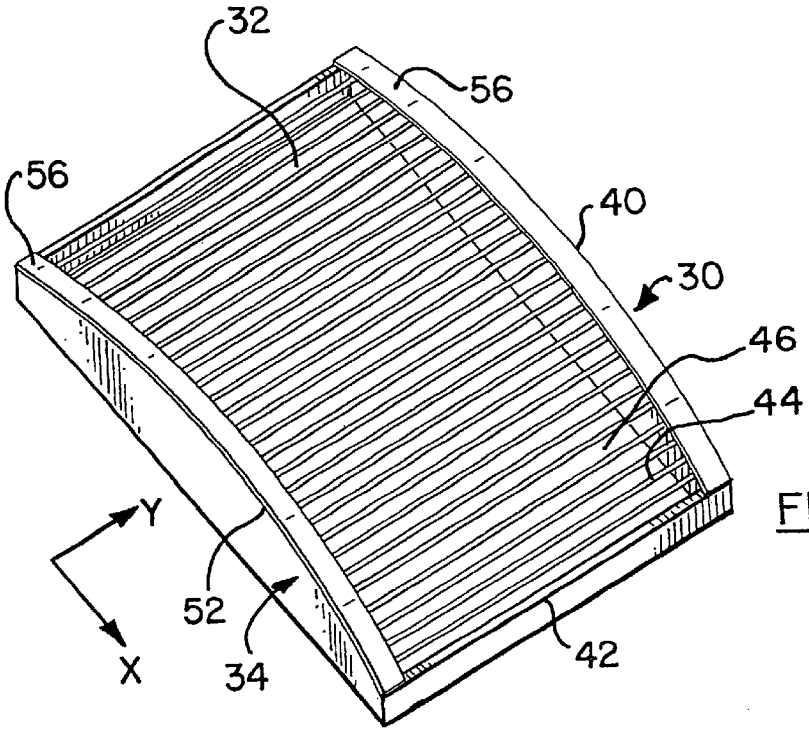
FIG. 2 is a perspective view of the mask frame assembly according to the present invention.

A mask frame assembly 30 is removably mounted, by conventional means, in a predetermined spaced relation to the screen 28. As illustrated in FIG. 2, the mask frame assembly 30 includes a tension mask 32 secured to a frame 34. The tension mask 32 may be a strand tension with frictionally connected damping wires, a strand tension focus mask or other similar structures known in the art. In accordance with the present invention, the tension mask 32 includes an active aperture portion that contains a plurality of parallel spaced-apart strands 44. A multiplicity of elongated apertures 46, between the strands 44, parallel the minor axis Y of the tension mask 32. The electron beams pass through the apertures 46 in the active portion during tube operation. The strands 44 each have a transverse dimension, or width, which could be equally spaced or graded by design. In an example, the width of the strands could be about 0.55 mm (21.5 mils). The apertures 46 are likewise equally spaced or graded by design. For example, each aperture could have a width of about 0.11 mm (5.5 mils) that approximately parallels the minor axis, Y, of the CRT.

An electron gun 38, shown schematically by dashed lines in FIG. 1, is centrally mounted within the neck 16 to generate three in-line electron beams (not shown), a center beam and two side or outer beams, along convergent paths through the slots in the tension mask 32 to the screen 28.

The tube 10 is designed to be used with an external magnetic deflection yokesuch as the yoke 39 shown in the neighborhood of the funnel to neck junction. When activated, the yoke 39 subjects the three beams to magnetic fields causing the beams to scan horizontally and vertically in a rectangular raster over the screen 28.

The frame 34, for supporting the tension mask 32,is shown in FIG. 2 and includes four sides: two long sides 40, substantially paralleling the major axis X of the tube, and two short sides 42, paralleling the minor axis Y of the tube. Each of the two long sides 40 includes a cantilever 52 secured to the distal ends of the short sides 42. Although the present invention is described in an embodiment using the frame 34, it is to be understood that many other types of tension frames could also be used with the present invention.

Figure 3:
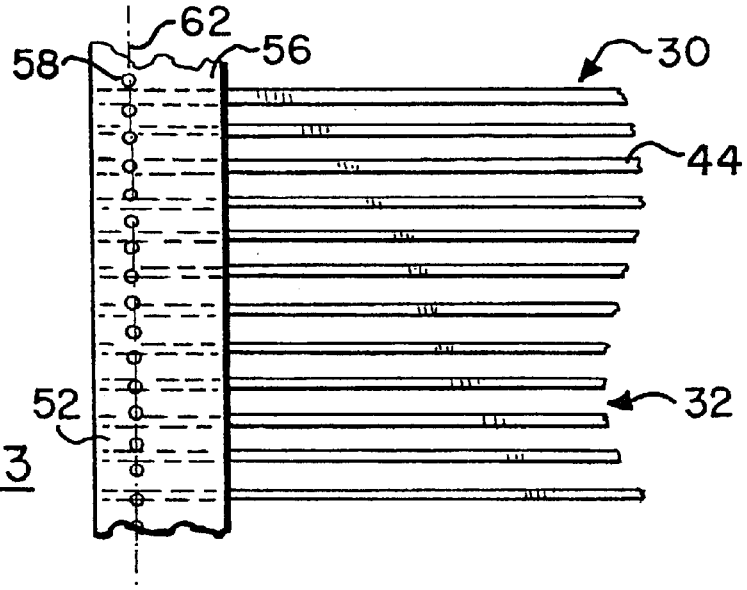
FIG. 3 is a plan view of a section of the strands welded between the mask frame and the border shield.

As best illustrated in FIGS. 2 and 3, the plurality of strands 44 are continued from the active portion to the two cantilevers 52, where they are positioned between the border shield 56 and the cantilevers 52 through weld points 58. A series of weld points 58 forms a weld line 62 that can be formed, for example, by a wheel-type resistance welder or by other welding methods, such as laser welding. The border shield 56 are welded over the strands along each edge of the frame cantilevers 52 and is incorporated to move into gripping relation with the respective strand ends, whereby the strands 44 are held to the cantilevers 52 in a predetermined space-apart relation.

In the preferred embodiment, the cantilevers 52 and border shields 56 are formed of a material having a high coefficient of thermal expansion (CTE) such as, a low carbon alloy steel or other suitable conventional steel. In contrast, the mask strands 44 are formed of a material having a low coefficient of thermal expansion. An iron-nickel alloy such as INVAR® (TM Reg. #63,970) or any other similar materials having a low coefficient of thermal expansion (CTE) are effective. When a low-thermal expansion mask with a solid border is affixed to a high-thermal expansion frame, thermal processing of the tube, which can reach temperatures as high as 450° C., can cause the mask to be inelastically stretched in the solid border region, and upon cool-down the mask wrinkles. In the absence of a solid border mask, the border shields 56 accommodate the greater expansion of the a high expansion frame 34 compared to that of the low expansion tension mask 32 with solid border attachment, without causing appreciable relocation of the mask strands 44 through permanent deformation of a mask border. The border shield 56 generally achieves this result by being a material having coefficient of thermal expansion similar to that of the frame, thereby avoiding wrinkles during thermal treatment. Hence, by securing the individual mask strands 44 to the cantilevers 52 of the frame 34, the lateral expansion of the tension mask 32 is controlled by the lateral expansion of the frame 34. An example includes the case where the frame 34 and the border shield 56 are composed of low carbon alloy steels, which can be referred to as high CTE materials and have CTEs in the range of 120 to 160×10-7/C°. In such a case no wrinkles will form even when the tension mask 32 is made of a low CTE material such as iron-nickel alloy material, which has a CTE is in the range of 9 to 30×10-7/C°.

Figure 4:
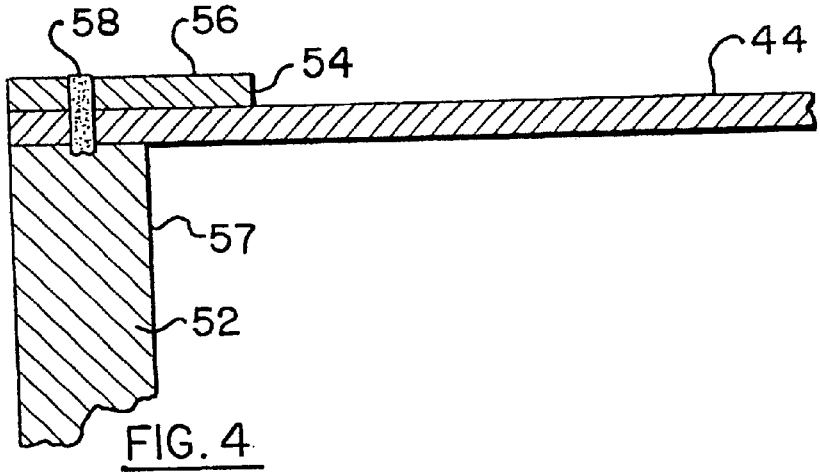
FIG. 4 is a cross-sectional side view of a section of the mask frame assembly illustrating the border shield, the mask strands, and the cantilever of the mask frame.

As shown in FIGS. 3 and 4, the tension mask 32 comprises a thin flat sheet of iron-nickel alloy etched into a plurality of strands 44. The strands 44 are aligned in a spaced-apart parallel fashion on the top of cantilevers 52. A predetermined tension on the strands 44 may be obtained by stretching the strands 44 such as, by compressing the cantilevers 52 toward the center of the mask 32, or by any other means known in the art. A border shield 56 is mounted, at each end of the frame 34, over the ends of the strands 44 and aligned with the exterior edge of the cantilever 52. The border shields 56 makes contact with the strands 44 and extend toward the center of the tension mask 32 such that the edge 54 of the border shield 56 overhangs the interior edge 57 of the cantilever 52. With the border shields 56 positioned over the strands 44, a welding device is scanned along the top surface of the border shield 56 securing the border shield 56 and strands 44 to the cantilever 52 by weld points 58, thereby completing the tension mask 32. During the welding process, the border shield 56 protects the strands 44 to minimize unwanted strand displacement caused by the pushing action of the welding device such as in the case of a wheel-rolling type resistance welder or the like. In one embodiment, the borders 56 and the mask strands 44 form a pre-assembly where the border shields 56 are precisely attached to the strands 44 with an adhesive prior to welding, thereby further ensuring that the strands 44 maintain their precision alignment and that the strands 44 will not be displaced by the welding action. Acrylic or epoxy resins or silicate binders are effective for such use.

Upon conjunction of the faceplate panel 14 with the tension mask 32 during final tube assembly, the tension mask 32 is mounted on studs (not shown) extending from the faceplate panel 14. The electron gun 38 produces an electron beam whose center of deflection is substantially coincident, in effect, with the pathway followed by the light source used in producing and locating the phosphor stripes on the screen 28. With the use of matrix and screening processes known in the art, the border shields 56 define the periphery in the matrix process and also define where the phosphor stripes are terminated in the vertical dimension.

The extension of the border shield 56 along the ends of frame 34 also provides an electron shield at the edge of the active electron beam scan region so that undesirable electron scattering from the cantilevers 52 during vertical overscan conditions can be reduced. In the preferred embodiment, the thickness of border shield 56 should be less than 0.1 in and extend from the cantilever 52 toward the center of the mask by at least 0.1 in.

As the embodiments that incorporate the teachings of the present invention have been shown and described in detail, those skilled in the art can readily devise many other varied embodiments that still incorporate these teachings without departing from the spirit of the invention. Other embodiments include (1) employing high CTE materials for the strands 44 and low CTE materials for the cantilevers 52 and the border shields 56, (2) employing high CTE materials for the strands 44, the cantilevers 52 and the border shields 56, and (3) employing low CTE materials for the strands 44, the cantilevers 52 and the border shields 56.

What is claimed is:

1. A tension mask for a cathode-ray-tube having a luminescent screen on a panel, comprising:

a mask frame having two opposed sides;

a cantilever attached to each opposing side of said frame;

a mask attached to said cantilevers, said mask having a plurality of spaced apart substantially parallel strands between which are elongated apertures through which electron beams pass during operations of the tube; and a border shield mounted over the strands along each cantilever.

2. The tension mask of claim 1, wherein the cantilevers and border shield are formed of a material with a first coefficient of thermal expansion and the strands are formed of a material with a second coefficient of thermal expansion.

3. The tension mask of claim 1, wherein the cantilevers, the border shields and the strands are formed of a similar material.

4. The tension mask frame assembly of claim 2, wherein the first coefficient of thermal expansion is greater than the second coefficient of thermal expansion.

5. The tension mask frame assembly of claim 2, wherein the first coefficient of thermal expansion is less than the second coefficient of thermal expansion.

6. In a cathode-ray tube having a mask frame assembly mounted within the tube, comprising:

a substantially rectangular mask frame having a pair of opposed cantilevers;

a tension mask having an active apertured portion formed by a plurality of spaced-apart vertically extending strands, each of the strands spanning between the cantilevers; and, a border shield mounted over the strand and fixed to the cantilevers whereby the strands are secured to the cantilevers, the tension mask having a lower coefficient of thermal expansion than that of the mask frame, cantilevers, and border shield.

7. The cathode-ray tube as defined in claim 6, wherein the border shield extends toward the active apertured portion of the tension mask.

8. The cathode-ray tube as defined in claim 6, wherein the tension mask is made from Invar and the frame, cantilevers, and border shield are made from steel.

9. The cathode-ray tube as defined in claim 6, wherein the border shield is precisely secured to the strands through an adhesive means prior to welding, thereby further preventing any displacement of the strands during welding.

10. The cathode-ray tube as defined in claim 9, wherein the adhesive means is an epoxy resin, an acrylic resin or a silicate binder.

* * * * *